US009417575B2

(12) United States Patent
Miura et al.

(10) Patent No.: US 9,417,575 B2
(45) Date of Patent: Aug. 16, 2016

(54) PRESSURE MEMBER CONFIGURED TO INHIBIT WRINKLE FORMATION AND FIXING DEVICE

(71) Applicant: CANON KABUSHIKI KAISHA, Tokyo (JP)

(72) Inventors: Jun Miura, Kawasaki (JP); Yutaka Arai, Kawasaki (JP); Shigeaki Takada, Abiko (JP); Akeshi Asaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/800,499

(22) Filed: Jul. 15, 2015

(65) Prior Publication Data

US 2016/0018772 A1 Jan. 21, 2016

(30) Foreign Application Priority Data

Jul. 17, 2014 (WO) ..... PCT/JP2014/069052

(51) Int. Cl.
*G03G 15/20* (2006.01)

(52) U.S. Cl.
CPC ..... *G03G 15/206* (2013.01); *G03G 2215/2035* (2013.01)

(58) Field of Classification Search
CPC ..... G03G 15/206; G03G 15/2089; G03G 15/2057; G03G 2215/2035
See application file for complete search history.

(56) References Cited

U.S. PATENT DOCUMENTS

| | | | | |
|---|---|---|---|---|
| 5,782,730 | A * | 7/1998 | Kawasaki | G03G 15/206 492/56 |
| 2012/0014726 | A1* | 1/2012 | Sekihara | G03G 15/206 399/333 |
| 2013/0209148 | A1* | 8/2013 | Suto | G03G 15/2053 399/333 |

FOREIGN PATENT DOCUMENTS

| | | | |
|---|---|---|---|
| JP | 2001-265147 | A | 9/2001 |
| JP | 2002-114860 | A | 4/2002 |
| JP | 2008-150552 | A | 7/2008 |
| JP | 2009-156965 | A | 7/2009 |
| JP | 2010-143118 | A | 7/2010 |
| JP | 2012-037874 | A | 2/2012 |
| WO | 2014/112358 | A1 | 7/2014 |

* cited by examiner

*Primary Examiner* — Clayton E Laballe
*Assistant Examiner* — Trevor J Bervik
(74) *Attorney, Agent, or Firm* — Canon USA, Inc., IP Division

(57) ABSTRACT

A pressure member includes a base, an elastic layer outside the base, and a surface layer on the elastic layer, the surface layer containing a fluorine-containing resin. The surface layer is fixed on the elastic layer in a state of being stretched in the longitudinal direction of the pressure member, the elastic layer has a porosity of 20% by volume or more and 60% by volume or less, and when the elastic modulus of the elastic layer in the thickness direction is defined as E (ND) and the elastic modulus of the elastic layer in the longitudinal direction of the pressure member is defined as E (MD), E (MD)/E (ND) is larger than 1.0.

11 Claims, 5 Drawing Sheets

PRESSURE MEMBER CONFIGURED TO INHIBIT WRINKLE FORMATION AND FIXING DEVICE

TECHNICAL FIELD

The present invention relates to a pressure member used in an apparatus configured to hold, convey, and heat a recording material, and relates to a fixing device including the pressure member.

BACKGROUND ART

In an apparatus configured to form an electrophotographic image, a heat fixing device including a heating member and a pressure member that is arranged so as to face the heating member is used as a heat fixing device configured to fix an unfixed toner image formed on a recording material to the recording material. The heat fixing device is a device configured to convey the recording material by the rotation of both the members while toner is fixed to the recording material by heat from the heating member and pressure due to pressure contact between both the members.

The pressure member includes a base configured to impart stiffness that withstands pressure contact with the heating member to the pressure member, an elastic layer configured to impart elasticity necessary for the formation of a nip portion to the pressure member, and a surface layer which is composed of a fluorocarbon resin in order to impart toner releasability to the pressure member.

To reduce the power consumption of the heat fixing device, it is desirable to reduce the time required to increase the temperature of the nip portion to a temperature required to fix toner (hereinafter, also referred to as a "warm-up time"). Thus, in the pressure member, the coefficient of thermal conductivity of the elastic layer is reduced by allowing the elastic layer of the pressure member to contain pores. That is, heat conduction through the pressure member is reduced to inhibit the dissipation of heat from the heating member to the base, thereby improving the rate of temperature increase of the heating member.

Here, the following three typical methods are known as methods for producing porous elastic layers having pores. In PTL 1, a foaming agent is mixed with an uncrosslinked silicone rubber. Then the resulting mixture is cured by heating while the mixture is foamed. In PTL 2, a hollow filler is mixed with an uncrosslinked silicone rubber in advance. The resulting mixture is subjected to crosslinking and forming, thereby forming pores. In PTL 3, a water-absorbing polymer that has absorbed water is dispersed in an uncrosslinked silicon rubber. After the crosslinking of the silicone rubber, dehydration is performed to form pores.

The pressure member is required to have improved durability in addition to the reduction in warm-up time described above. In the case where the heat fixing device is used over long periods of time, a wrinkle extending in the circumferential direction of the pressure member (hereinafter, also referred to simply as a "circumferential direction") can be formed on a surface of the pressure member. In the case where the wrinkle extending in the circumferential direction is formed, a defect can occur in an image portion corresponding to the wrinkle when a different size electrophotographic image is formed.

To inhibit the occurrence of such a wrinkle extending in the circumferential direction, in general, a method is employed in which in the production process of the pressure member, the surface layer is fixed on the elastic layer in a state of being stretched in the longitudinal direction (axial direction) of the pressure member. This suppresses the looseness of the surface layer in the longitudinal direction.

PTL 4 discloses a fixing member in which a fluorine-containing resin tube is fixed on an elastic layer using an adhesive layer with the fluorine-containing resin tube in a state of being stretched in the longitudinal direction.

CITATION LIST

Patent Literature

PTL 1 Japanese Patent Laid-Open No. 2008-150552
PTL 2 Japanese Patent Laid-Open No. 2001-265147
PTL 3 Japanese Patent Laid-Open No. 2002-114860
PTL 4 Japanese Patent Laid-Open No. 2010-143118

In the case where pores in an elastic layer are increased in order to meet a recent demand for a further reduction in warm-up time, even when a surface layer is fixed on an elastic layer in a state of being stretched in the longitudinal direction under tension as described above, a wrinkle extending in the circumferential direction is sometimes formed in the surface layer.

One aspect of the present invention is directed to providing a pressure member configured to achieve both of a reduction in warm-up time and the inhibition of the formation of a wrinkle extending in the circumferential direction at a high level. Another aspect of the present invention is directed to providing a heat fixing device configured to stably form a high-quality electrophotographic image.

SUMMARY OF INVENTION

According to one aspect of the present invention, there is provided a pressure member including a base, an elastic layer on the base, and a surface layer on the elastic layer, the surface layer containing a fluorine-containing resin, in which the surface layer is fixed on the elastic layer in a state of being stretched in the longitudinal direction of the pressure member, the elastic layer has a porosity of 20% by volume or more and 60% by volume or less, and when the elastic modulus of the elastic layer in the thickness direction is defined as E (ND) and the elastic modulus of the elastic layer in the longitudinal direction of the pressure member is defined as E (MD), E (MD)/E (ND) is larger than 1.0.

Furthermore, according to another aspect of the present invention, there is provided a heat fixing device including a heating member and a pressure member facing the heating member, the pressure member being in pressure contact with the heating member, in which a material to be heated is introduced into a nip portion between the heating member and the pressure member, held, conveyed, and heated, and in which the pressure member is the pressure member described above.

Further features of the present invention will become apparent from the following description of exemplary embodiments with reference to the attached drawings.

BRIEF DESCRIPTION OF DRAWINGS

FIGS. 1A to 10 illustrate explanatory drawings of the occurrence of a wrinkle in the circumferential direction.

FIG. 2 is a schematic diagram of a heat fixing device according to an embodiment of the present invention.

FIG. 3 is a perspective view of a pressure member according to an embodiment of the present invention.

FIG. 4 is a schematic diagram of a needle-like filler.

FIG. 5 is an enlarge perspective view of a sample cut from an elastic layer.

FIG. 6 is an enlarged view of a circumferential section (section a) of a sample cut from an elastic layer.

FIG. 7 is an enlarged view of a longitudinal section (section b) of a sample cut from an elastic layer.

FIG. 8 is an explanatory drawing of the definition of an orientation ratio.

FIG. 9 is a schematic explanatory drawing of a mold for cast molding, the mold being used for the production of a pressure member.

DESCRIPTION OF EMBODIMENTS

The inventors have conducted studies on the reason a wrinkle extending in the circumferential direction (hereinafter, also referred to as a "wrinkle in the circumferential direction") is easily formed in a surface layer fixed on an elastic layer with the surface layer in a state of being stretched in the longitudinal direction under tension when the elastic layer has increased porosity, and have found the following findings.

Figure 1A:
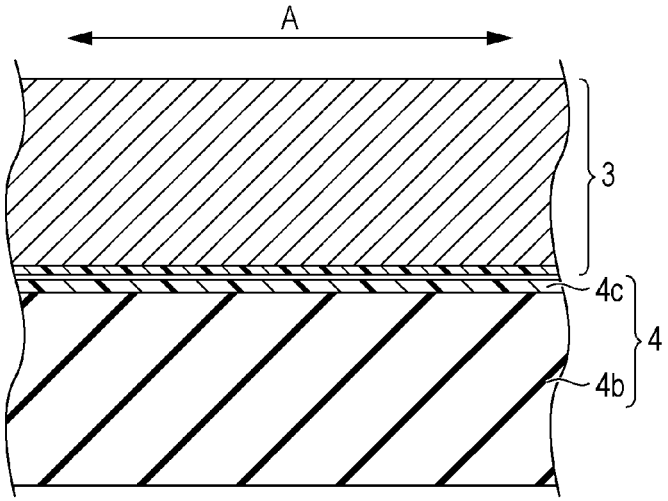

The wrinkle extending in the circumferential direction due to long-term use will be described in detail with reference to FIGS. 1A to 10. FIGS. 1A to 10 illustrate explanatory drawings of an assumed mechanism for the formation of the wrinkle extending in the circumferential direction in the surface layer and enlarged sectional views of a region of a nip portion through which an end portion of a recording material passes, the views being taken in a direction orthogonal to a direction in which a sheet is conveyed in the fixing device. A direction indicated by an arrow A in FIG. 1A is a width direction of the fixing device.

Figure 1B:
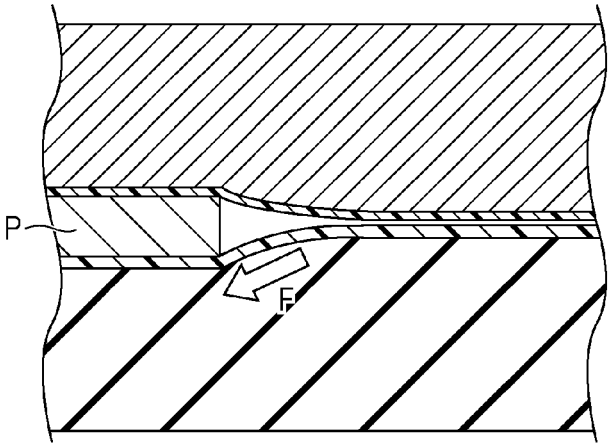

FIG. 1A illustrates a state in which a heating member 3 is in pressure contact with a pressure member 4 before the passage of a recording material P. FIG. 1B illustrates a state in which the recording material P is passing through the nip portion. FIG. 10 illustrates a state in which wrinkle W is formed in a surface layer of the pressure member 4 after repetitions of the passage of recording materials for prolonged periods of time. The pressure member 4 includes an elastic layer 4*b* and a surface layer 4*c*.

When the recording material P passes through the nip portion, the recording material allows the pressure member to undergo compression deformation in the thickness direction of the pressure member (hereinafter, also referred to as a "thickness direction"). By the deformation, in particular, a portion of the surface layer 4*c* corresponding to the vicinity of an end portion of the recording material P extends in a direction indicated by an arrow F in FIG. 1B. The extension of the elastic layer in the direction indicated by the arrow F corresponds to the longitudinal direction of the pressure member before the deformation (the axial direction of the member: hereinafter, referred to as a "longitudinal direction"). Whenever the recording material P passes therethrough, the elongation and contraction of the surface layer 4*c* are repeated in the longitudinal direction.

Figure 1C:
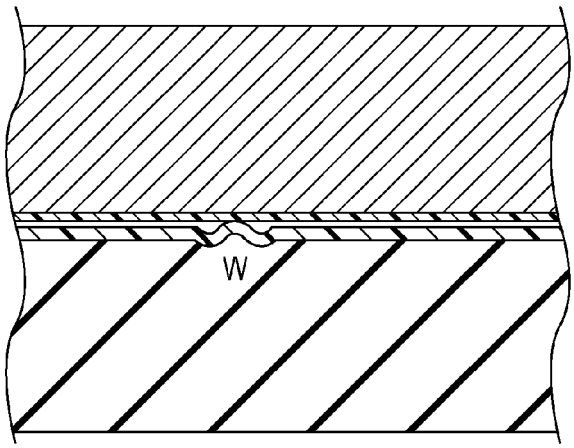

A fluorine-containing resin used for the surface layer 4*c* typically has a glass transition temperature of about 100° C. Toner usually has a fixing temperature higher than the temperature. Thus, when the recording material passes, the temperature of the fluorine-containing resin is higher than the glass transition temperature. When elongation and contraction of the surface layer 4*c* in the vicinity of the end portion of the recording material are repeated in such temperature environment, a residual stress in the surface layer is relieved, the residual stress being remained in the surface layer due to fixation of the surface layer on the elastic layer in a state of being stretched in the longitudinal direction. This will cause the formation of wrinkle W as illustrated in FIG. 1C.

Here, an increase in the porosity of the elastic layer 4*b* in order to reduce the warm-up time of the heat fixing device reduces the elastic modulus of the elastic layer 4*b* and increases the amount of elongation of the surface layer 4*c* in the longitudinal direction. Thus, a wrinkle is easily formed by the relief of the residual stress in the surface layer 4*c*.

The inventors have focused attention on the elastic modulus of the elastic layer in the longitudinal direction. Hitherto, in the pressure member including the elastic layer 4*b* having pores, the elastic modulus E (MD) of the elastic layer 4*b* in the longitudinal direction has been substantially equivalent to the elastic modulus E (ND) of the elastic layer 4*b* in the thickness direction. In contrast, in the pressure member according to the present invention, the elastic modulus of the elastic layer 4*b* in the longitudinal direction is relatively large. That is, E (MD)/E (ND) is larger than 1.0. In this structure, the amount of elongation of the surface layer 4*c* in the longitudinal direction at the time of the passage of the recording material P through the nip portion is small, compared with the elastic layer in which E (MD)/E (ND) is 1.0. It is thus possible to inhibit the formation of a wrinkle generated by the relief of the surface layer 4*c* even in the case of the pressure member including the elastic layer having high porosity.

A pressure member and a heat fixing device according to the present invention will be specifically described below.

(1) Heat Fixing Device

Figure 2:
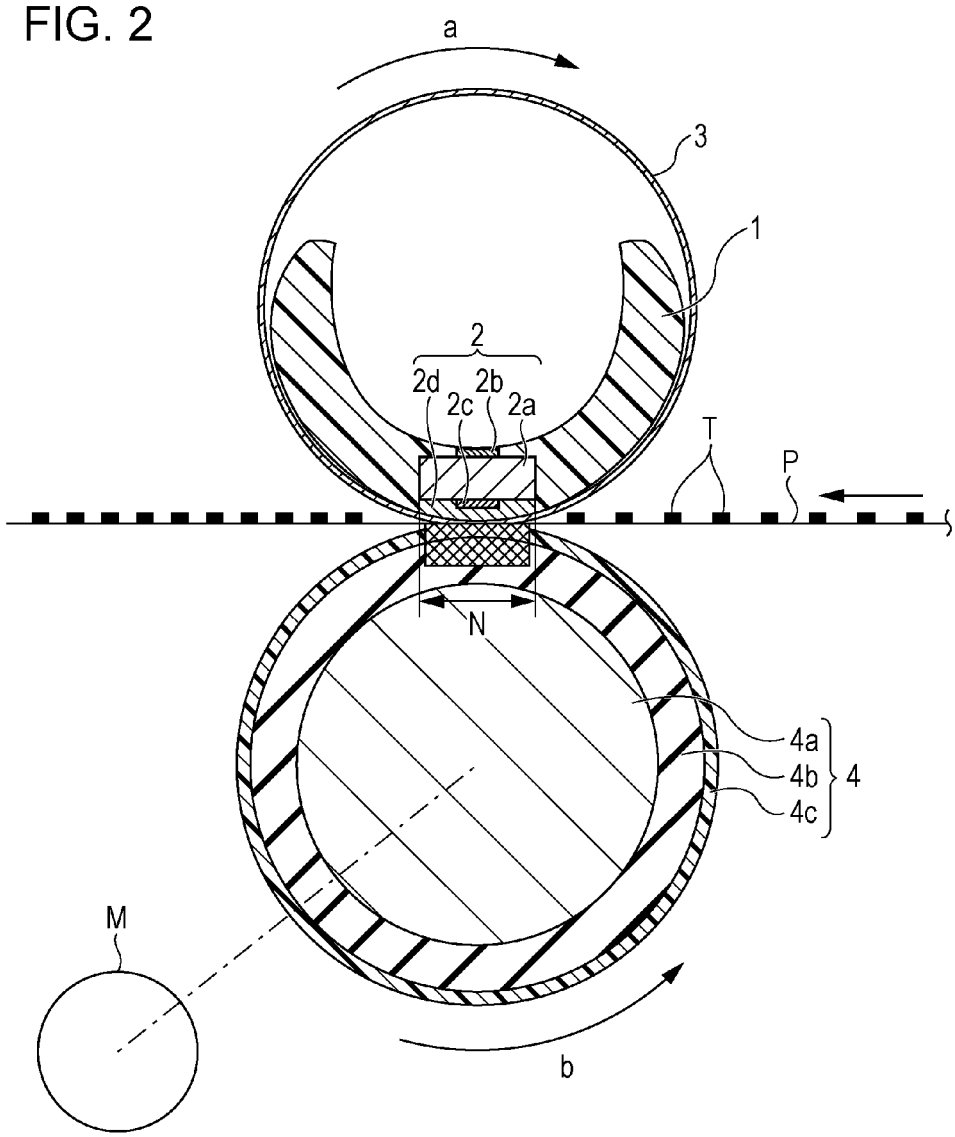

FIG. 2 is a cross-sectional view of a heat fixing device according to an embodiment of the present invention. The heat fixing device is what is called an on-demand-type heat fixing device (hereinafter, referred to as an "ODF") and is a film-heating-type heat fixing device including a ceramic heater serving as a heat source. The on-demand-type heat fixing device is taken as an example, and the outline structure thereof will be described below. The heat fixing device of the present invention is not limited to the structure. In addition to this, the present invention may be applicable to other heat fixing devices, which are generally used, such as a heat-roller-type heat fixing device including a halogen heater as a heat source and an induction-heating (IH)-type heat fixing device (hereinafter, referred to as an "IHF") in which a member itself is heated by the energization of a coil.

In FIG. 2, a film guide member 1 is an oblong film guide member whose width direction is a direction parallel to the longitudinal direction of a base, the film guide member having an arc or gutter shape in cross section. A heater 2 is an oblong heater (heating means serving as one of elements included in the heating member) held in a groove formed in the lower portion located in the approximate middle of the film guide member 1, the groove extending in the width direction. A film 3 is a film-like endless belt having a cylindrical shape and is loosely fitted at the outside of the film guide member 1 provided with the heater 2.

The film guide member 1 is a formed article composed of a heat-resistant resin, for example, polyphenylene sulfide (PPS) or a liquid-crystalline polymer.

The heater 2 has a structure in which a heating resistor is arranged on a ceramic substrate. The heater 2 illustrated in FIG. 2 includes an oblong sheet-like heater substrate 2*a* composed of alumina and a linear or narrow-strip electrical heating element (heating resistor) 2*c* composed of Ag/Pd, the electrical heating element 2*c* being located on the surface side (on the side of the film sliding surface) of the heater substrate 2*a* and extending in the longitudinal direction of the base. The heater 2 includes a thin surface protective layer 2*d* configured to cover and protect the electrical heating element 2*c*, the surface protective layer 2*d* being composed of glass. A thermistor (temperature-detecting element) 2*b* is in contact with the backside of the heater substrate 2*a*. After a quick rise in temperature by the supply of electric power to the electrical heating element 2*c*, the heater 2 can be controlled by electric power control means (not illustrated) including the temperature-detecting element 2*b* so as to maintain a predetermined fixing temperature. The fixing temperature is a target temperature of a surface of a fixing member and is appropriately set, depending on a printing speed, the type of sheet, the structure of the fixing member, and the type of toner. The fixing temperature is typically 150° C. or higher and 200° C. or lower.

The film 3 is, for example, a composite layer film in which a base film is coated with a surface layer. The film preferably has a total thickness of 500 μm or less in order to reduce heat capacity and improve the quick-start performance.

As a material for the base film, a resin material, for example, polyimide (PI), polyamide-imide (PAI), polyetheretherketone (PEEK), or polyether sulfone (PES), or a metal material, for example, stainless steel (SUS) or Ni, is used.

As a material for the surface layer, a fluorocarbon resin material, for example, polytetrafluoroethylene (PTFE), tetrafluoroethylene-perfluoroalkyl vinyl ether (PFA), or tetrafluoroethylene-hexafluoropropylene copolymer (FEP), is used.

An elastic layer composed of a silicone rubber and an adhesive layer may be appropriately arranged between the base film and the surface layer.

The pressure member 4 is arranged so as to face the lower surface of the heater 2 and is in pressure contact with the heater 2 with the film 3 provided therebetween. The heater 2 and the film 3 are included in the heating member. The heater 2 functions as heating means for heating the film 3.

The pressure member 4 is pressed against the surface protective layer 2*d* of the heater 2 with the film 3 provided therebetween with a predetermined pressure mechanism (not illustrated) at a predetermined pressure load. The elastic layer 4*b* of the pressure member 4 is elastically deformed, depending on the pressure load, to form a nip portion N having a predetermined width required for the fixation of an unfixed toner image by heat, the nip portion N being located between a surface of the pressure member 4 and a surface of the film 3. The pressure load is appropriately set, depending on the type of sheet, size, the type of toner, and the structure of the fixing device used in a product. The pressure load is typically set in the range of about 10 kgf to about 70 kgf.

The recording material P serving as a material to be heated is introduced into the nip portion N. The recording material P is held, conveyed, and heated.

The pressure member 4 is rotationally driven in the counterclockwise direction indicated by an arrow b at a predetermined circumferential velocity by transmitting a driving force from a driving source M through a gear (power transmission mechanism, not illustrated).

The pressure member 4 is rotationally driven in the counterclockwise direction indicated by the arrow b at the time of the implementation of image formation. The rotation of the pressure member 4 allows the film 3 to be rotationally driven in the direction indicated by the arrow a.

(2) Layer Structure of Pressure Member

An example of the layer structure of the pressure member 4 will be described in detail below.

Figure 3:
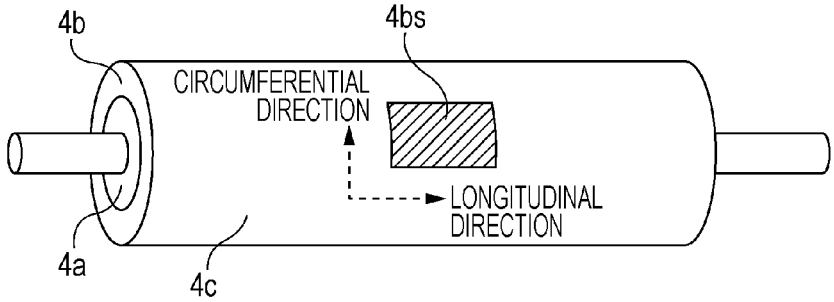

FIG. 3 is a perspective view of the pressure member 4. In FIG. 3, the pressure member 4 includes a base 4*a*, the elastic layer 4*b* containing a silicone rubber, and the surface layer 4*c* composed of a fluorine-containing resin.

The base 4*a* is composed of a metal, for example, iron, aluminum, nickel, or stainless steel (SUS). In the case of mounting the pressure member 4 on the heat fixing device, the pressure member 4 is pressed while both shaft portions serving as end portions at which the elastic layer is not arranged are supported by bearings (bearing members). Thus, the base 4*a* needs to have strength to withstand the pressure load, so that iron or stainless steel (SUS) is preferably used. Regarding a portion where the elastic layer is to be formed on a surface of the portion, the surface is typically subjected to adhesive treatment in advance. With respect to the adhesive treatment, physical treatments, such as blast treatment and polishing treatment, and chemical treatments, such as oxidation treatment, primer treatment, and coupling agent treatment, are performed separately or in combination.

The elastic layer 4*b* is formed of a single layer. The thickness of the elastic layer 4*b* is not particularly limited as long as the nip portion having a desired width is formed. Preferably, the elastic layer 4*b* has a thickness of 2 to 5 mm.

The thickness of the surface layer 4*c* is not particularly limited as long as sufficient releasability is imparted to the pressure member 4. Preferably, the surface layer 4*c* has a thickness of 20 to 50 μm.

(3) Elastic Layer of Pressure Member

The elastic layer included in the pressure member according to the present invention has a porosity of 20% by volume or more and 60% by volume or less. The ratio of the elastic modulus E (MD) of the elastic layer in the longitudinal direction of the pressure member to the elastic modulus E (ND) of the elastic layer in the thickness direction, i.e., E (MD)/E (ND) (hereinafter, this ratio is also referred to as an "elastic modulus ratio") is larger than 1.0.

The elastic layer of the pressure member according to an embodiment of the present invention has many pores and thus inhibits heat transfer from the heating member to the pressure member to reduce the warm-up time of the device.

In the elastic layer of the pressure member according to an embodiment of the present invention, the elastic modulus E (ND) in the thickness direction is larger than the elastic modulus E (MD) in the longitudinal direction. Thus, in comparison with the pressure member in which both the elastic moduli are at the same level, the elongation of the surface layer in the longitudinal direction due to the passage of the recording material is inhibited, so that a wrinkle is less likely to be formed even after long-term use.

Figure 4:
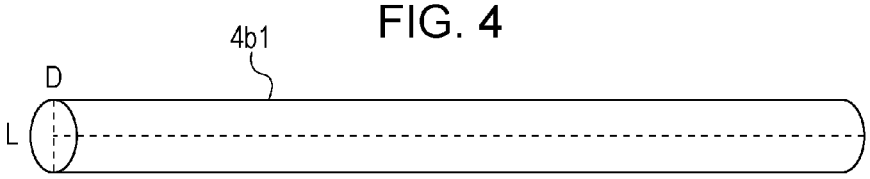

The elastic layer will be described in more detail below with reference to FIGS. 4 to 7. In the elastic layer according to the an embodiment of present invention, a needle-like filler illustrated in FIG. 4 is substantially oriented in the longitudinal direction in the elastic layer, and the elastic modulus ratio in the range described above is achieved.

Figure 5:
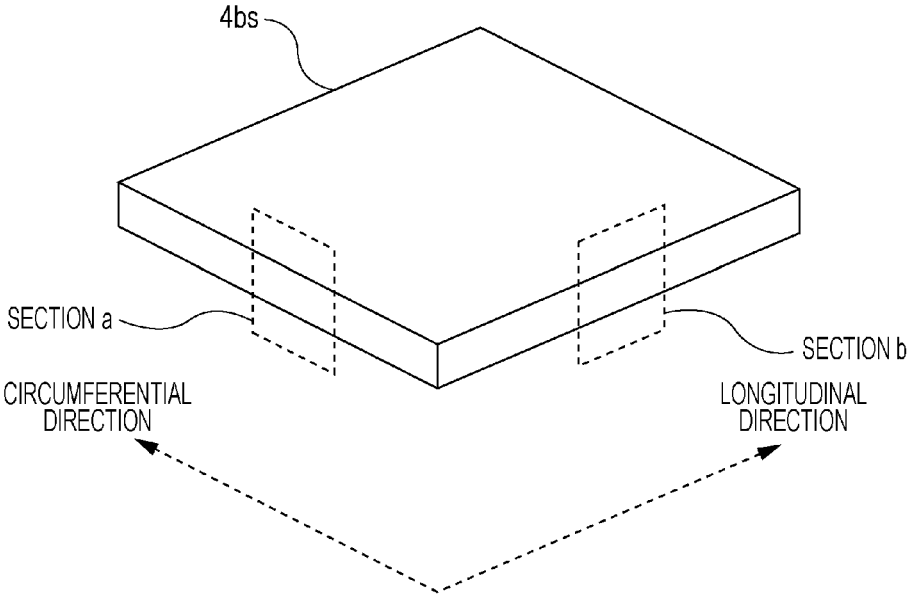
Figure 6:
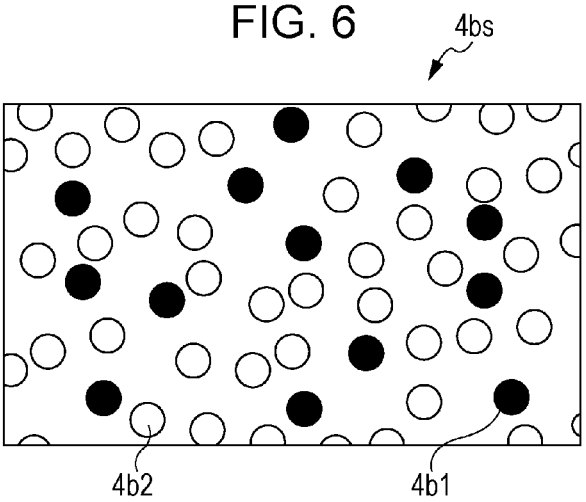
Figure 7:
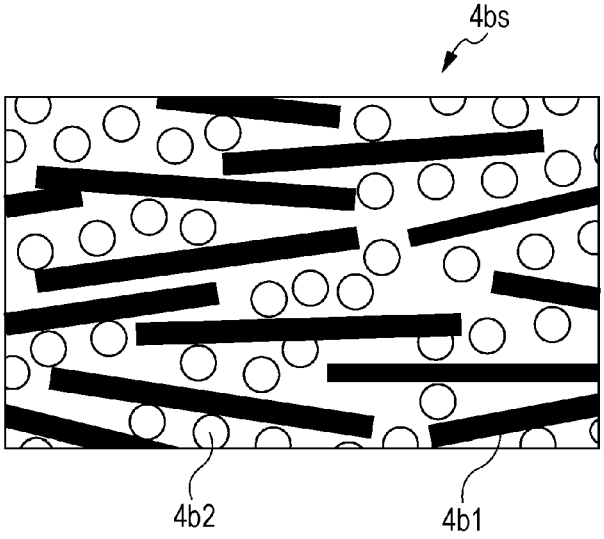

FIG. 6 is an enlarged perspective view of a sample 4*bs* that is cut out from the elastic layer 4*b* as illustrated in FIG. 3. In a section of the sample 4*bs* in the circumferential direction (section a in FIG. 5), the section of a needle-like filler 4*b*1 in the direction of the thickness D is mainly observed as illustrated in FIG. 6. In a section of the sample 4*bs* in the longitudinal direction (section b in FIG. 5), the side face of the needle-like filler 4*b*1 is mainly observed as illustrated in FIG. 7. In both FIGS. 6 and 7, pores 4*b*2 are observed.

(3-1) Elastic Modulus E (MD) in Longitudinal Direction and Elastic Modulus E (ND) in Thickness Direction Regarding the elastic layer, the ratio of the elastic modulus E (MD) of the pressure member in the longitudinal direction to the elastic modulus E (ND) of the pressure member in the thickness direction, i.e., E (MD)/E (ND), is a value larger than 1.0. In particular, E (MD)/E (ND) is preferably 2.0 or more and 15.0 or less.

In the pressure member according to an embodiment of the present invention, the pressure member including the elastic layer in which E (MD)/E (ND) meets the foregoing requirement, the elongation of the elastic layer caused at the time of the passage of the recording material through the nip portion is inhibited, compared with a pressure member in which E (MD)/E (ND) is 1.0 or less. As a result, the repeated elongation of the surface layer, which follows the elastic layer, in the longitudinal direction is also inhibited. Thus, in the pressure member according to the present invention, the formation of a wrinkle is inhibited even after long-term use.

In particular, E (MD)/E (ND) is preferably 2.0 or more because the formation of a wrinkle is inhibited, and the durability of the pressure member is improved. In the case where E (MD)/E (ND) is more than 15.0, it is necessary to increase the elastic modulus E (MD) of the elastic layer in the longitudinal direction by allowing the elastic layer to contain a large amount of the needle-like filler. Alternatively, it is necessary to reduce the elastic modulus E (ND) of the elastic layer in the thickness direction by allowing the elastic layer to have many pores. However, in any case, the proportion of a rubber component present in the elastic layer is reduced. This may cause a reduction in formability in the production process of the pressure member and a break of the pressure member in the fixing nip.

The elastic modulus ratio in the range described above can be achieved by allowing the needle-like filler to be substantially oriented in the longitudinal direction in the elastic layer. The elastic modulus E (ND) in the thickness direction of the elastic layer according to the present invention is preferably 0.2 MPa or more and 2.5 MPa or less. An elastic modulus of 0.2 MPa or more results in strength sufficient to use the pressure member in the heat fixing device. At an elastic layer of 2.5 MPa or less, in the case where the pressure member according to the present invention is mounted on an image-forming apparatus, it is possible to ensure a nip width required to form an image by printing.

The elastic modulus ratio is determined as described below. A measurement sample is cut from the elastic layer of the pressure member with a razor. Regarding the measurement sample, the elastic modulus E (MD) of the elastic layer in the longitudinal direction and the elastic modulus E (ND) in the thickness direction are measured by a method described below. The measurement is performed five times for each elastic modulus. The elastic modulus ratio is determined using the resulting average values as the respective elastic moduli.

Each of the elastic moduli may be measured with a dynamic viscoelastometer (trade name: Rheogel-E4000, manufactured by UBM Co., Ltd). The elastic modulus E (MD) in the longitudinal direction is defined as a value obtained by attaching a tensile jig to the viscoelastometer and measuring a complex modulus at a distance between chucks of 20 mm using a sinusoidal wave with a frequency of 100 Hz and an amplitude of 0.003 mm in an environment with a temperature of 200° C. The measurement sample is cut out in such a manner that a tensile direction in the measurement is parallel to the longitudinal direction of the sample 4*bs*. The elastic modulus E (ND) in the thickness direction is defined as a value obtained by attaching a compression jig to the viscoelastometer and measuring a complex modulus using a sinusoidal wave with a frequency of 100 Hz and an amplitude of 0.003 mm in an environment with a temperature of 200° C. The measurement sample is cut out in such a manner that a compression direction in the measurement is parallel to the thickness direction of the measurement sample.

A base polymer and the needle-like filler contained in the elastic layer 4*b* and the pores present in the elastic layer 4*b* illustrated in FIG. 2 will be described in detail below.

(3-2) Base Polymer

A base polymer in the elastic layer 4*b* is produced by crosslinking and curing an addition curable-type liquid silicone rubber. The addition curable-type liquid silicone rubber is an uncrosslinked silicone rubber that contains organopolysiloxane (A) containing an unsaturated bond, for example, a vinyl group, and organopolysiloxane (B) containing a Si—H bond (hydride). The unsaturated bond and Si—H undergo an addition reaction under heat, so that the crosslinking and curing proceed. The base polymer with desired hardness can be produced by appropriately adjusting the amounts of organopolysiloxane (A) containing an unsaturated bond and organopolysiloxane (B) containing a Si—H bond (hydride).

The organopolysiloxane (A) typically contains a platinum compound serving as a catalyst that promotes the reaction. The flowability of the addition curable-type liquid silicone rubber may be adjusted as long as the object of the present invention is not impaired. In the present invention, a filler, a filling material, and a compounding agent which are not described in the present invention and which serve as solutions to known problems may be contained in the elastic layer 4*b* without departing from the scope of the features of the invention.

(3-3) Needle-Like Filler

The needle-like filler is usually harder than the base polymer. The orientation of the needle-like filler in the longitudinal direction in the elastic layer inhibits the deformation of the elastic layer in the longitudinal direction. Thus, the elastic modulus of the elastic layer in the longitudinal direction is relatively large, compared with the elastic modulus in the thickness direction.

A higher content of the needle-like filler 4*b*1 in the elastic layer 4*b* has a tendency to lead to a larger elastic modulus ratio, E (MD)/E (ND), of the elastic layer. The content of the needle-like filler 4*b*1 is preferably 2% by volume or more with respect to the elastic layer. A content of the needle-like filler of 2% by volume or more results in further improvement in the elastic modulus of the elastic layer in the longitudinal direction, thereby enhancing the effect of inhibiting the formation of a wrinkle. The content of the needle-like filler 4*b*1 in the elastic layer 4*b* is preferably 15% by volume or less. A content of the needle-like filler of 15% by volume or less facilitates the molding of the elastic layer 4*b*. Furthermore, it is possible to avoid excessively reducing the elasticity of the elastic layer. This easily ensures the nip portion serving as a pressure member of the heat fixing device.

As illustrated in FIG. 4, the needle-like filler with high ratio of its length L to its diameter D may be preferably used. That is, a material with a high aspect ratio may be preferably used. The bottom of the needle-like filler may have a circular or angular shape.

Specific examples of the needle-like filler include pitch-based carbon fibers, PAN-based carbon fibers, glass fibers, and inorganic whiskers. Regarding a more specific shape of the needle-like filler, with reference to FIG. 4, a needle-like filler with a diameter D of 5 to 11 μm (average diameter), a length L (average length) of 50 μm or more and 1000 μm or less, and an aspect ratio of 5 or more and 120 or less is industrially easily available. The length L is 50 μm or more; hence, the needle-like filler is effectively oriented in the longitudinal direction of the pressure member.

The aspect ratio of the needle-like filler may be determined by means of the following formula from the average length and the average diameter of the needle-like filler:

Aspect ratio=average length/average diameter

The average length and the average diameter of the needle-like filler are values obtained by measuring the length and the diameter of at least 100 randomly-selected particles of the needle-like filler with an optical microscope and calculating the arithmetic mean values of the resulting values.

In the case where the needle-like filler is a carbon fiber, a method for calculating the aspect ratio will be specifically described below. A sample cut from the elastic layer is burnt to ashes at 700° C. for 1 hour in a nitrogen gas atmosphere. The resulting ashes are removed. In this way, the needle-like filler in the sample can be taken. As described above, 100 or more particles of the needle-like filler are randomly selected. The length and the diameter thereof are measured with an optical microscope, and then the aspect ratio is determined.

To effectively increase the elastic modulus ratio, E (MD)/E (ND), of the elastic layer, an orientation ratio is preferably 50% or more. It is difficult to obtain the elastic layer having an orientation ratio more than 70%.

The definition of the orientation ratio of the needle-like filler in the longitudinal direction will be described with reference to FIG. 8.

As illustrated in FIG. 3, the sample 4*bs* for the evaluation of the orientation ratio of the elastic layer 4*b* is cut from the elastic roller with a razor. As the evaluation sample 4*bs*, a thickness region having a thickness of 30% of the thickness of the elastic layer is cut from the surface layer of the elastic layer remote from the base.

Figure 8:
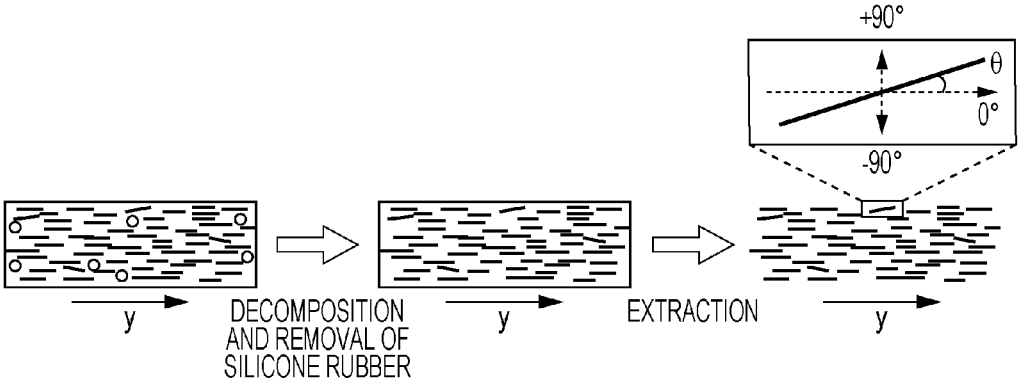

FIG. 8 is an explanatory drawing for a procedure for measuring the orientation ratio of the needle-like filler in the evaluation sample 4*bs*.

The evaluation sample 4*bs* is heated at 1000° C. for 1 hour in a nitrogen atmosphere with a thermogravimetric analyzer (trade name: TGA851e/SDTA, manufactured by Mettler-Toledo International Inc.), thereby decomposing and removing the silicone rubber.

In the case where the sample is burned as described above, even when the sample has the fluorocarbon resin layer on a surface, the fluorocarbon resin layer is also removed together with the silicone rubber. In the evaluation sample 4*bs* in which the silicone rubber has been removed, the needle-like filler is left alone while maintaining an orientation state when the silicone rubber is present. Observations are made on five portions of the elastic layer 4*b* in the section b, which is illustrated in FIG. 5, of the evaluation sample 4*bs* in which the silicone rubber has been removed. For the observations, a confocal microscope (trade name: OPTELICS C130, manufactured by Lasertec Corporation) is used.

Angles of the needle-like filler particles are measured from the observed images of the section b.

In the observed images of the section b of the evaluation sample 4*bs*, the needle-like filler present in a region extending from an observation surface to a position 50 μm from the observation surface in the depth direction is observed. That is, it is possible to observe a state of the needle-like filler present in a region extending from the section b to a position 50 μm from the section b in the y-axis direction in the observed images of the section b.

Here, the angle of the elastic layer 4*b* in the longitudinal direction of the roller (the y direction in FIG. 8) is defined as 0°. The angle θ of each of the needle-like fillers is calculated. In the case where the angle θ of each of the needle-like fillers is closer to 0°, a higher degree of orientation of the needle-like fillers in the longitudinal direction of the roller is provided.

The proportion of the needle-like fillers having an angle θ within ±5° [(the number of the needle-like filler particles having an angle within ±5°/the total number of the needle-like fillers that can be observed)×100%] is determined from the observed images of the section b. The average value of the measurement results in the freely-selected five portions is defined as an orientation ratio.

(3-4) Pores

In the elastic layer 4*b* according to an embodiment of the present invention, the pores 4*b*2 are present together with the oriented needle-like filler 4*b*1.

Regarding the pore diameter of the pores in the elastic layer according to an embodiment of the present invention, when the elastic layer is cut in the thickness direction with a razor, 80% by number or more of pores appearing in the section preferably have a pore diameter ranging from 5 to 30 μm. Here, the pore diameter is determined as follows: The section is observed with a scanning electron microscope (for example, trade name: XL-30, manufactured by FEI Company, magnification: 100×). Binarization is performed in a predetermined region (for example, 297×204 pixels). The pore diameter is defined as a value of ½ of the total of the maximum length and the minimum length of each pore portion. In the case where 80% by number or more of the pores in the section have a pore diameter within the range described above, the strength of the elastic layer can be sufficiently maintained.

The elastic layer 4*b* has a porosity of 20% by volume or more and 60% by volume or less. A porosity of 20% by volume or more results in the effect of sufficiently reducing the warm-up time. When an attempt is made to form an elastic layer having a porosity more than 60% by volume, it is difficult to perform molding. Furthermore, at a porosity more than 60% by volume, the strength is sometimes insufficient for the pressure member of the heat fixing device. The porosity is preferably 40% by volume or more and 60% by volume or less because a higher porosity results in a shorter warm-up time.

The porosity of the elastic layer 4*b* may be determined as follows: The elastic layer is cut at a freely-selected position with a razor. The volume of the resulting portion of the elastic layer at 25° C. is measured with a specific gravity hydrometer (SGM-6, manufactured by manufactured by Mettler-Toledo International Inc.) (hereinafter, the resulting volume is denoted by $V_{all}$). Next, the evaluation sample in which the volume measurement has been performed is heated at 700° C. for 1 hour in a nitrogen gas atmosphere with a thermogravimetric analyzer (trade name: TGA851e/SDTA, manufactured by Mettler-Toledo International Inc.) to decompose and remove the silicone rubber component. Here, the amount of reduction in weight is denoted by $M_p$. In the case where the elastic layer 4*b* further contains an inorganic filler in addition to the needle-like filler, the residue after the decomposition and the removal is a mixture of the needle-like filler and the inorganic filler.

In this state, the volume at 25° C. is measured with a dry automatic densitometer (trade name: AccyPyc 1330-1, available from Shimadzu Corporation) (hereinafter, the volume is denoted by $V_a$). The porosity can be determined from a formula described below on the basis of these values. The calculation is performed using a density of the silicone rubber component of 0.97 g/cm$^3$ (hereinafter, the density is denoted by $\rho_p$).

$$\text{Porosity(\% by volume)}=[\{(V_{all}-(M_p/\rho_p+V_a)\}/V_{all}]\times 100$$

As the porosity used in examples, the average value in the five samples randomly cut is used.

(4) Surface Layer

The surface layer 4*c* is fixed on the elastic layer in a state of being stretched in the longitudinal direction of the pressure member. As a material for the surface layer, a fluorine-containing resin is preferably used in view of the releasability of the recording material P at the time of the printing of an image. Specific examples of the fluorine-containing resin include tetrafluoroethylene-perfluoro(alykyl vinyl ether) copolymer (PFA), polytetrafluoroethylene (PTFE), and tetrafluoroethylene-hexafluoropropylene copolymer (FEP). These materials listed above may be used in combination as a blend of two or more thereof. An additive may be added as long as the effects of the present invention are not impaired.

The surface layer is fixed on the elastic layer in a state of being stretched in the longitudinal direction. Thus, the surface layer has residual stress in the longitudinal direction and is in a state in which a wrinkle in the circumferential direction is less likely to be formed. The fact that the surface layer is fixed on the elastic layer in a state of being stretched in the longitudinal direction may be confirmed. Reference length L1 is taken on the surface layer of the pressure member in the longitudinal direction, and L1 is accurately measured. The elastic layer is dissolved in a solvent that can dissolve a silicone rubber (for example, trade name: e Solv 21RS, manufactured by Kaneko Chemical Co., Ltd). Length L2 of the surface layer in the longitudinal direction in a state in which the surface layer is not fixed on the elastic layer is measured. In the case where a comparison between L1 and L2 indicates that L2 is shorter, it is confirmed that the surface layer has been fixed on the elastic layer in a state of being stretched in the longitudinal direction. The elongation percentage of the surface layer may be specifically determined from the following formula:

$$\text{Elongation percentage (\%)}=\{(L1-L2)/L2\}\times 100$$

As a method for fixing the surface layer on the elastic layer with the surface layer in a state of being stretched in the longitudinal direction, the following methods are exemplified. Any of the methods may be employed for the fixation of the surface layer. Examples thereof include (a) a method in which a fluorocarbon resin tube is fixed in a cylindrical mold in a state of being stretched in the longitudinal direction and then a material for the elastic layer is injected thereinto, cured, and bonded; (b) a method in which after the formation of the elastic layer, a fluorocarbon resin tube is bonded using an adhesive in a state of being stretched in the longitudinal direction; and (c) a method in which a fluorocarbon resin tube that is heat-shrinkable in the longitudinal direction is used.

The elongation percentage is typically 1% or more and 5% or less. A higher elongation percentage results in a higher residual stress in the surface layer in the longitudinal direction, so that a wrinkle in the circumferential direction tends to be less likely to be formed.

(5) Method for Producing Pressure Member

The pressure member configured to achieve both of a reduction in warm-up time and the inhibition of the formation of a wrinkle in the circumferential direction in the surface layer at a high level may be produced by a production method described below.

(5-1) Step of Preparing Liquid Composition for Formation of Elastic Layer

In a method for forming the pore-containing elastic layer according to an embodiment of the present invention, an emulsion-like liquid composition containing a water-containing gel, the base polymer, and the needle-like filler is preferably used.

After an elastic layer in which water is finely dispersed is formed from the emulsion-like liquid composition containing the water-containing gel, the elastic layer is dehydrated to provide the elastic layer containing fine pores.

As the aqueous gel, a material produced by allowing a water-absorbing polymer and a clay mineral to contain water and swell may be used. The water-containing gel dispersed in the emulsion-like liquid composition has a diameter of about 1 to about 30 μm and is less likely to inhibit the orientation of the needle-like filler. It is thus possible to form the high-porosity elastic layer in which the needle-like filler is highly oriented.

In the case where a liquid composition containing hollow particles (about 40 μm) together with the needle-like filler is injected into a mold for cast molding to form an elastic layer, when the hollow particles flow in the cavity of the mold, shells of the hollow particles inhibit the orientation of the needle-like filler. It is thus difficult to form an elastic layer that achieves both of high porosity and the high degree of orientation of the needle-like filler.

In the case where a liquid composition containing a foaming agent together with the needle-like filler is injected into a mold for cast molding to form an elastic layer, the orientation of the needle-like filler is inhibited by foaming of the foaming agent. It is thus difficult to orient the needle-like filler in the longitudinal direction.

In the case where the elastic layer according to an embodiment of the present invention is produced from the emulsion-like liquid composition containing the water-containing gel, the base polymer, and the needle-like filler, the water-containing gel, the base polymer, and the needle-like filler are mixed together and stirred with known mixing and stirring means, such as a planetary versatile mixer/stirrer, thereby preparing an emulsion-like liquid composition in which water microdroplets are dispersed.

Examples of the water-absorbing polymer in the water-containing gel include polymers, copolymers, and crosslinked materials of acrylic acid, methacrylic acid, and metal salts thereof. Of these, alkali metal salts of polyacrylic acid and crosslinked materials thereof may be preferably used. These are industrially easily available (trade name: RHEOGIC 250H, manufactured by Toagosei Co., Ltd). A water-swollen clay mineral having the effect of increasing viscosity is suitable for the preparation of the emulsion-like liquid composition for the formation of the elastic layer. An example of the clay mineral is Bengel W-200U (trade name, manufactured by Hojun Co., Ltd).

After the addition of an emulsifier and a viscosity modifier as needed, mixing and stirring may be performed to prepare a liquid composition. An example of an additive for emulsification is a surfactant, such as a nonionic surfactant (sorbitan fatty acid ester, trade name: Ionet HLB 4.3, manufactured by Sanyo Chemical Industries, Ltd).

The elastic layer having a porosity of 20% by volume or more and 60% by volume or less according to the present invention may be produced by adjusting the amount of water in the liquid composition for the formation of the elastic layer. Specifically, the density of the water-containing gel and the density of the base polymer composed of the liquid silicone rubber are each 1.0 g/cm$^3$. In the case where the needle-like filler is a pitch-based carbon fiber used in examples described below, the needle-like filler has a density of 2.2 g/cm$^3$. The amount of the water-containing gel is adjusted on the basis of these values in such a manner that the volume of the water-containing gel is 20% to 60% by volume with respect to the total volume of the liquid composition used for the formation of the elastic layer. Thereby, it is possible to produce the elastic layer having a porosity of 20% by volume or more and 60% by volume or less.

(5-2) Step of Forming Layer of Liquid Composition

The liquid composition prepared in item (5-1) described above is injected into the cavity of a mold for cast molding, the base 4*a* with a surface subjected to primer treatment being arranged in the mold.

After a fluorocarbon resin tube is fixed on the inner surface of the mold for cast molding in a state of being stretched in a direction parallel to the axis of the base (in the longitudinal direction after the molding of the pressure member) in advance, the liquid composition is injected thereinto. Thereby, the fluorocarbon resin of the pressure member can be fixed on the elastic layer in a state of being stretched in the longitudinal direction.

Figure 9:
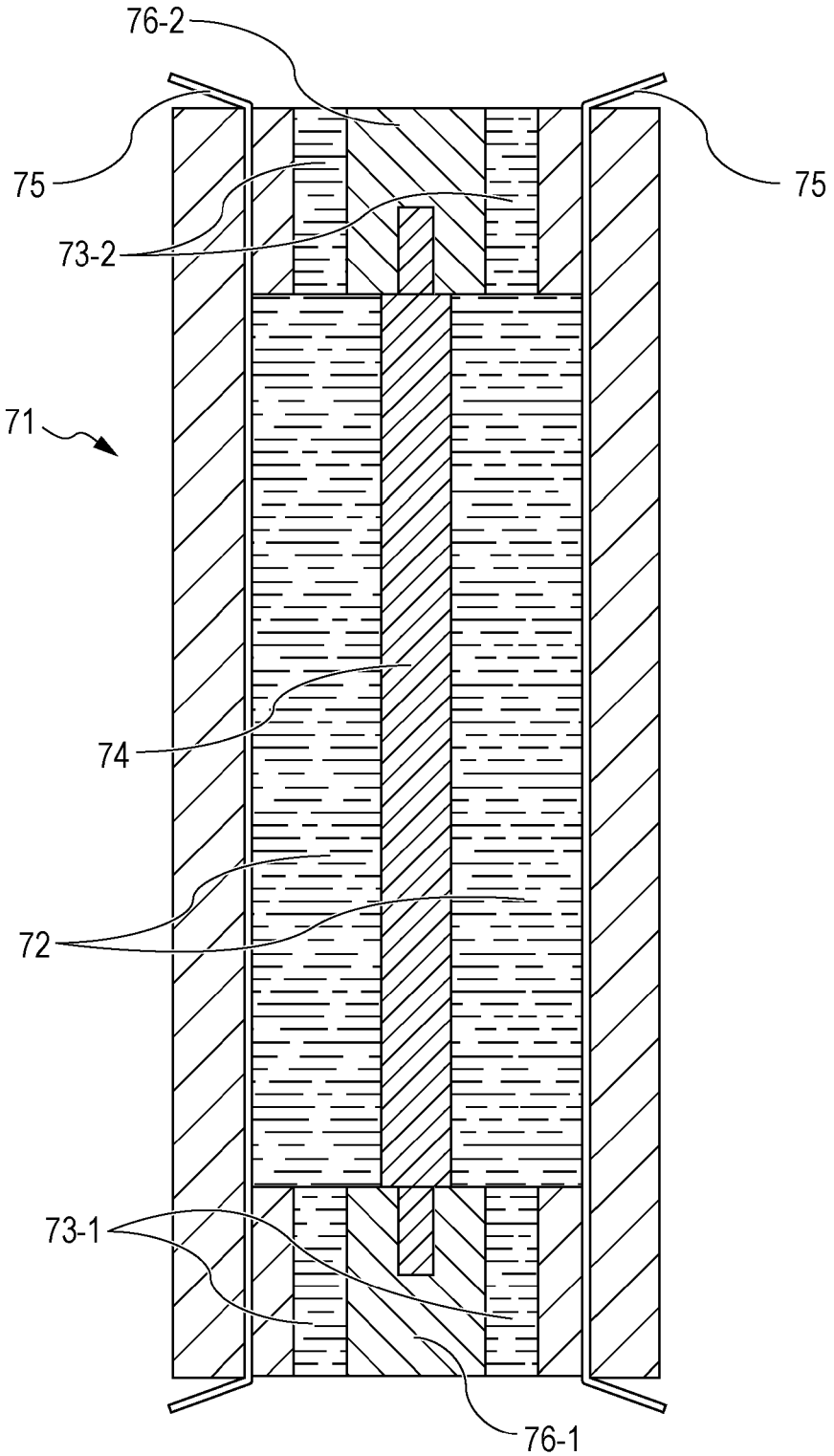

This step will be specifically described with reference to FIG. 9. FIG. 9 is a sectional view of a mold 71 for cast molding, the view being taken in the longitudinal direction, and the mold being used for the pressure member according to an embodiment of the present invention. In FIG. 9, a fluorocarbon resin tube 75 with an inner surface with a cylindrical shape is fixed to the mold 71 for cast molding in a state of being stretched in the longitudinal direction. The base (mandrel) 74 of the pressure member according to an embodiment of the present invention is arranged in the mold 71 for cast molding and supported by bearings 76-1 and 76-2. A cavity is formed between the outer periphery of the mandrel 74 and the inner periphery of the mold 71 for cast molding. The cavity 72 communicates with the outside through communication paths 73-1 and 73-2.

The liquid composition according to an embodiment of the present invention is injected through the communication paths 73-1 serving as channels for the liquid composition to fill the cavity 72 with the liquid composition. As a result, the needle-like filler 4*b*1 in the liquid composition is substantially oriented in the longitudinal direction of the base in accordance with the flow of the liquid composition.

The elastic modulus ratio E (MD)/E (ND) of the elastic layer may be controlled by adjusting each of the elastic modulus E (MD) and the elastic modulus E (ND). A lower elastic modulus E (ND) and a larger elastic modulus E (MD) result in a larger elastic modulus ratio E (MD)/E (ND).

The elastic modulus E (ND) may be controlled by adjusting the porosity of the elastic layer, the hardness of the rubber, the content of the needle-like filler in the elastic layer, and the orientation ratio of the needle-like filler.

For example, an increase in the hardness of the rubber in the elastic layer, an increase in the content of the needle-like filler, and a reduction in the orientation ratio of the needle-like filler provide a larger elastic modulus E (ND). Of these, the adjustment of the porosity is particularly effective in controlling the elastic modulus E (ND). A higher porosity results in a lower elastic modulus E (ND). As described above, the porosity may be controlled by adjusting the volume of the water-containing gel with respect to the total volume of the liquid composition.

The elastic modulus E (ND) is preferably 0.2 MPa or more and 2.5 MPa or less. To obtain an elastic modulus E (ND) within the range described above, it is preferable to use a base polymer having an elastic modulus of 0.5 MPa or more and 2.5 MPa or less when the base polymer is cured at 200° C. for 4 hours.

The elastic modulus E (MD) may be controlled by adjusting the content and the orientation ratio of the needle-like filler in the elastic layer, the porosity of the elastic layer, and the hardness of the base rubber. Of these, it is effective to adjust the content and the orientation ratio of the needle-like filler in the elastic layer.

Specifically, a higher content of the needle-like filler in the elastic layer results in a larger elastic modulus E (MD). More specifically, the volume of the needle-like filler is preferably 2% by volume or more with respect to the total volume of the liquid composition used for the formation of the elastic layer in such a manner that the content of the needle-like filler in the elastic layer is 2% by volume or more.

A higher orientation ratio of the needle-like filler results in a larger elastic modulus E (MD). More specifically, in order to increase the elastic modulus E (MD), an orientation ratio of 50% or more is preferred.

There are effective methods for achieving a higher orientation ratio of the needle-like filler in the longitudinal direction: that is, an increase in the aspect ratio of the needle-like filler, an increase in the viscosity of the emulsion-like liquid composition for the formation of the elastic layer, and an increase in the injection rate of the emulsion-like liquid composition for the formation of the elastic layer into the cavity of the mold for cast molding. For example, the needle-like filler preferably has an aspect ratio of 5 or more and 120 or less. The injection rate of the liquid composition is adjusted in such a manner that at 25° C., the liquid composition has a viscosity of 30 to 150 [Pa·s] at a shear rate of 10 [1/s] and a viscosity of 20 to 100 [Pa·s] at a shear rate of 20 [1/s] and that the liquid composition in the cavity has an average flow rate of 4.0 [mm/sec] or more. Thereby, it is possible to form the elastic layer having a high orientation ratio of the needle-like filler. At an excessively high average flow rate, an excessive shear force is applied to the liquid composition at the time of injection to break the emulsion state of the liquid composition, thereby failing to form an elastic layer having uniform pores, in some cases. Thus, the average flow rate is preferably 50 [mm/sec] or less. In the case where the liquid composition is charged into the cavity at the average flow rate described above, the needle-like filler in the elastic layer has an orientation ratio of about 60% to about 70%.

The average flow rate (mm/s) may be determined from the following formula:

$$\text{Average flow rate(mm/s)} = \text{injection volume of liquid composition per second into cavity(mm}^3\text{/s)} / \text{cross-sectional area of cavity(mm}^2\text{)}$$

(5-3) Step of Crosslinking and Curing Silicone Rubber Component

The cavity filled with the liquid composition is hermetically sealed. Heating is performed at a temperature lower than the boiling point of water, for example, at 60° C. to 90° C., for 5 minutes to 120 minutes to cure the silicone rubber component. The liquid composition is heated at a temperature lower than the boiling point of water, thus forming an elastomer in which water microdroplets are uniformly dispersed in the liquid composition.

The cavity is hermetically sealed; hence, the silicone rubber component is cured while water in the water-containing gel dispersed in the liquid composition is maintained.

(5-4) Demolding Step

After the mold is appropriately cooled with water or air, the base 4*a* on which a layer formed by crosslinking and curing the liquid composition in step (5-3) is laminated is demolded.

(5-5) Dehydration Step

The liquid composition layer laminated on the base 4*a* is dehydrated by heat treatment to form the pores 4*b*2. Regarding the conditions of the heat treatment, preferably, the temperature is in the range of 100° C. to 250° C., and the heating time is in the range of 1 to 5 hours.

(5-5) Step of Laminating Surface Layer

As described above, the surface layer may be laminated by the method in which after the fluorocarbon resin tube is fixed and arranged inside the mold 71 for cast molding in advance in a state of being stretched in the longitudinal direction, the liquid composition is injected into the mold. To bond the surface layer to the elastic layer, if necessary, the inner surface of the fluorocarbon resin tube may be appropriately subjected to coating with a primer before the injection of the liquid composition into the mold. Alternatively, the surface layer 4*c* may also be laminated by the method in which after the formation of the elastic layer, the elastic layer is covered and bonded with the fluorocarbon resin tube while the fluorocarbon resin tube is in a state of being stretched in the longitudinal direction.

EXAMPLES

Materials used in examples described below are listed below.

Base

Regarding the base 4*a*, iron mandrels in response to the thicknesses of elastic layers of pressure members were prepared. A mold for cast molding used in examples described below had an inside diameter of 30 mm. For example, in order to achieve a thickness of an elastic layer of 2.5 mm, a base having an outside diameter of 25 mm was prepared.

Base Polymer

An addition curable-type liquid silicone rubber having a viscosity of 10 Pa·s at a shear rate of 10 (1/s) in an environment with a temperature of 25° C. was prepared as a base polymer, the addition curable-type liquid silicone rubber having an elastic modulus of a value described in Section "Elastic modulus of rubber" in Table 1 when cured at 200° C. for 4 hours.

Water-Containing Gel

Regarding a water-containing gel, 99 parts by mass of ion exchanged water was added to 1 part by mass of a thickener (trade name: Bengel W-200U, manufactured by Hojun Co., Ltd) containing sodium polyacrylate as a main component and a smectite-based clay mineral. The resulting mixture was sufficiently stirred to swell, thereby preparing a water-containing gel.

Needle-Like Filler

Regarding the needle-like filler 4*b*1, fibrous materials listed below were prepared and used.

Pitch-based carbon fiber, trade name: GRANOC Milled Fiber XN-100-05M (manufactured by Nippon Graphite Fiber Corporation), fiber diameter: 9 μm, fiber length: 50 μm, aspect ratio: 6, density: 2.2 g/cm$^3$, hereinafter, referred to as "100-05M".

Pitch-based carbon fiber, trade name: GRANOC Milled Fiber XN-100-15M (manufactured by Nippon Graphite Fiber Corporation), fiber diameter: 9 μm, fiber length: 150 μm, aspect ratio: 17, density: 2.2 g/cm$^3$, hereinafter, referred to as "100-15M".

Pitch-based carbon fiber, trade name: GRANOC Milled Fiber XN-100-25M (manufactured by Nippon Graphite Fiber Corporation), fiber diameter: 9 μm, fiber length: 150 μm, aspect ratio: 28, density: 2.2 g/cm$^3$, hereinafter, referred to as "100-25M".

Pitch-based carbon fiber, trade name: GRANOC Chopped Fiber XN-100-01Z (manufactured by Nippon Graphite Fiber Corporation), fiber diameter: 9 μm, fiber length: 1 mm, aspect ratio: 111, density: 2.2 g/cm$^3$, hereinafter, referred to as "100-01".

PAN-based carbon fiber, trade name: Torayca Milled Fiber MLD-300 (manufactured by Toray Industries, Inc.), fiber diameter: 7 μm, fiber length: 130 μm, aspect ratio: 19, density: 1.8 g/cm$^3$, hereinafter, referred to as "MLD-300".

Glass fiber, trade name: EFH150-01 (manufactured by Central Glass Fiber Co., Ltd.), fiber diameter: 11 μm, fiber length: 150 μm, aspect ratio: 14, density: 2.6 g/cm$^3$, hereinafter, referred to as "150-01".

PFA Tube

Regarding the surface layer 4*c*, PFA tubes each formed by extrusion molding in response to dimensions of a pressure member so as to have a predetermined thickness were prepared. Regarding materials for the surface layer, three types of PFA listed below were used.

Trade name: Teflon PFA 451HP-J (manufactured by Du Pont-Mitsui Fluorochemicals Company, Ltd.), hereinafter, referred to as "451HP-J".

Trade name: Fluon PFA P-66P (manufactured by Asahi Glass Co., Ltd.), hereinafter, referred to as "P-66P".

Trade name: Teflon PFA 350-J manufactured by Du Pont-Mitsui Fluorochemicals Company, Ltd.), hereinafter, referred to as "350-J".

Production of pressure member

Experimental Example A

Example A-1

The base polymer composed of the addition curable-type liquid silicone rubber having an elastic modulus of 1.1 MPa when cured at 200° C. for 4 hours was prepared. The uncrosslinked addition curable-type liquid silicone rubber, needle-like filler "100-25M", and the water-containing gel were mixed. The resulting mixture was stirred for 30 minutes at a rotation speed of an impeller of 80 rpm with a versatile mixer/stirrer (trade name: T. K. HIVIS MIX 2P-1, manufactured by PRIMIX Corporation), thereby preparing a liquid composition in an emulsion state. In this case, the uncrosslinked addition curable-type liquid silicone rubber, the needle-like filler, and the water-containing gel were mixed in such a manner that the porosity was 20% by volume and the content of the needle-like filler was 11% by volume as described in Table 1.

As illustrated in FIG. 9, the PFA tube 75 (trade name: 451HP-J, manufactured by Du Pont-Mitsui Fluorochemicals Company, Ltd.), serving as a surface layer, having an inner surface that had been subjected to adhesive treatment with a primer (trade name: DY39-067, manufactured by Dow Corning Toray Co., Ltd.) and having a thickness of 30 μm and an outside diameter of 24.0 mm was inserted into the cavity of the pipe-shaped mold 71 for cast molding, the mold having an inside diameter of 25 mm, and was fixed on the inner surface of the mold 71 for cast molding in a state of being stretched by 1.0% in the longitudinal direction. Subsequently, the iron base 74 (diameter: 20 mm, length of region for formation of elastic layer: 250 mm), serving as a base that had been subjected to adhesive treatment with a primer (trade name: DY39-051, manufactured by Dow Corning Toray Co., Ltd.), for an A4-size roller was arranged inside the mold for cast molding while supported by the bearings (76-1 and 76-2) located at both end portions.

The previously prepared liquid composition was charged into the cavity through the communication paths 73-1. The average flow rate of the liquid composition was 15 mm/sec. The mold was hermetically sealed by means, not illustrated, while the cavity was filled with the liquid composition.

The mold for cast molding was heated at 90° C. for 1 hour in a hot-air oven to cure the silicone rubber. After cooling the mold for cast molding, the roller-shaped formed article was taken from the mold for cast molding.

The roller-shaped formed article was heated at 130° C. for 4 hours and then at 200° C. for 4 hours in the hot-air oven to evaporate water in a cured silicone rubber layer, thereby producing an elastic layer containing the needle-like filler substantially oriented in the direction along the base, having pores, and being formed of a single layer. Finally, excess end portions were cut to provide pressure member No. A-01.

In the case of pressure member No. A-01, the orientation ratio of the needle-like filler was 64%. The elastic modulus E (ND) of the elastic layer in the thickness direction was 1.5 MPa. The elastic modulus E (MD) of the elastic layer in the longitudinal direction was 13.5 MPa. The ratio E (MD)/E (ND) was 9.0. It was confirmed that the elongation percentage of the surface layer in the longitudinal direction was measured by the method described above and found to be 1.0%. In the measurement of the elongation percentage in the longitudinal direction, evaluation was made with a pressure member produced in the same production method as in pressure member No. A-01. The measurement results of the physical properties of pressure member No. A-01 are listed in Table 1.

Comparative Example A-1

In this comparative example, a liquid composition was prepared as in Example A-1, except that the uncrosslinked addition curable-type liquid silicone rubber and the water-containing gel were mixed without the needle-like filler. The uncrosslinked addition curable-type liquid silicone rubber and the water-containing gel were mixed in such a manner that the elastic layer of the resulting pressure member had a porosity of a value described in Table 1. Except for the conditions described here, molding was performed under the same conditions as in Example A-1, thereby providing pressure member No. A-02. The measurement results of the physical properties of pressure member No. A-02 are listed in Table 1.

Comparative Example A-2

A liquid composition was prepared as in Example A-1, except that the uncrosslinked addition curable-type liquid silicone rubber, the needle-like filler, and the water-containing gel were mixed in such a manner that in the resulting pressure member, the porosity was 10% by volume and the content of the needle-like filler was 11% by volume, as described in Table 1. Thereafter, molding was performed in the same conditions as in Example A-1, thereby providing pressure member No. A-03. The measurement results of the physical properties of pressure member No. A-03 are listed in Table 1.

Experimental Example B

Example B-1

As the needle-like filler, "100-15M" was used. The uncrosslinked addition curable-type liquid silicone rubber, the needle-like filler, and the water-containing gel were mixed as in Example A-1 to prepare a liquid composition in an emulsion state. In this case, the uncrosslinked addition curable-type liquid silicone rubber, the needle-like filler, and the water-containing gel were mixed in such a manner that in the resulting pressure member, the porosity was 40% by volume and the content of the needle-like filler was 5% by volume as described in Table 1.

Molding for the formation of the pressure member was performed as in Example A-1, except for the conditions specified below. A PFA tube (trade name: P-66P, manufactured by Du Pont-Mitsui Fluorochemicals Company, Ltd.), serving as a surface layer, having an inner surface that had been subjected to adhesive treatment with a primer and having a thickness of 30 μm and an outside diameter of 28.8 mm was inserted into the cavity of the pipe-shaped mold for cast molding, the mold having an inside diameter of 25 mm, and was fixed on the inner surface of the mold for cast molding in a state of being stretched by 1.5% in the longitudinal direction. Subsequently, an iron mandrel (diameter: 20 mm, length of region for formation of elastic layer: 320 mm), serving as a base that had been subjected to adhesive treatment with a primer, for an A3-size roller was arranged inside the mold for cast molding while supported by the bearings located at both end portions.

Pressure member No. B-01 was produced as in Example A-1 with the previously prepared liquid composition. The measurement results of the physical properties of pressure member No. B-01 are listed in Table 1.

Comparative Example B-1

In this comparative example, a liquid composition was prepared by mixing the uncrosslinked addition curable-type liquid silicone rubber and the water-containing gel without the needle-like filler. The uncrosslinked addition curable-type liquid silicone rubber and the water-containing gel were mixed in such a manner that in the resulting pressure member, the porosity as described in Table 1 was obtained. Except for the conditions described here, molding was performed under the same conditions as in Example B-1, thereby providing pressure member No. B-02. The measurement results of the physical properties of pressure member No. B-02 are listed in Table 1.

Experimental Example C

Example C-1

As the needle-like filler, "100-01" was used. The uncrosslinked addition curable-type liquid silicone rubber, the needle-like filler, and the water-containing gel were mixed as in Example A-1 to prepare a liquid composition in an emulsion state. In this case, the uncrosslinked addition curable-type liquid silicone rubber, the needle-like filler, and the water-containing gel were mixed in such a manner that in the resulting pressure member, the porosity was 40% by volume and the content of the needle-like filler was 13% by volume as described in Table 1.

Molding for the formation of the pressure member was performed as in Example A-1, except for the conditions specified below. A PFA tube (trade name: 350-J, manufactured by Du Pont-Mitsui Fluorochemicals Company, Ltd.), serving as a surface layer, having an inner surface that had been subjected to adhesive treatment with a primer and having a thickness of 30 μm and an outside diameter of 24.0 mm was inserted into the cavity of the pipe-shaped mold for cast molding, the mold having an inside diameter of 30 mm, and was fixed on the inner surface of the mold for cast molding in a state of being stretched by 1.0% in the longitudinal direction. Subsequently, an iron mandrel (diameter: 24 mm, length of region for formation of elastic layer: 320 mm), serving as a base that had been subjected to adhesive treatment with a primer, for an A3-size roller was arranged inside the mold for cast molding while supported by the bearings located at both end portions.

Thereafter, pressure member No. C-01 was produced as in Example A-1 with the previously prepared liquid composition. The measurement results of the physical properties of pressure member No. C-01 are listed in Table 1.

Comparative Example C-1

In this comparative example, a liquid composition was prepared by mixing the uncrosslinked addition curable-type liquid silicone rubber and the water-containing gel without the needle-like filler. The uncrosslinked addition curable-type liquid silicone rubber and the water-containing gel were mixed in such a manner that in the resulting pressure member, the porosity as described in Table 1 was obtained. Except for the conditions described here, molding was performed under the same conditions as in Example C-1, thereby providing pressure member No. C-02. The measurement results of the physical properties of pressure member No. C-02 are listed in Table 1.

Experimental Example D

Example D-1

As the needle-like filler, "100-25M" was used. The uncrosslinked addition curable-type liquid silicone rubber, the needle-like filler, and the water-containing gel were mixed as in Example A-1 to prepare a liquid composition in an emulsion state. In this case, the uncrosslinked addition curable-type liquid silicone rubber, the needle-like filler, and the water-containing gel were mixed in such a manner that in the resulting pressure member, the porosity was 50% by volume and the content of the needle-like filler was 8% by volume as described in Table 1.

Molding for the formation of the pressure member was performed as in Example A-1, except for the conditions specified below. A PFA tube (trade name: 451HP-J, manufactured by Du Pont-Mitsui Fluorochemicals Company, Ltd.), serving as a surface layer, having an inner surface that had been subjected to adhesive treatment with a primer and having a thickness of 25 μm and an outside diameter of 28.8 mm was inserted into the cavity of the pipe-shaped mold for cast molding, the mold having an inside diameter of 30 mm, and was fixed on the inner surface of the mold for cast molding in a state of being stretched by 3.0% in the longitudinal direction. Subsequently, an iron mandrel (diameter: 24 mm, length of region for formation of elastic layer: 320 mm), serving as a base that had been subjected to adhesive treatment with a primer, for an A3-size roller was arranged inside the mold for cast molding while supported by the bearings located at both end portions.

Thereafter, pressure member No. D-01 was produced as in Example A-1 with the previously prepared liquid composition. The measurement results of the physical properties of pressure member No. D-01 are listed in Table 1.

Examples D-2 and D-3

Pressure member Nos. D-02 and D-03 were produced in the same conditions as in Example D-1, except that MLD-300 and 150-1 were used, respectively, as the needle-like filler. The measurement results of the physical properties of pressure member Nos. D-02 and D-03 are listed in Table 1.

Comparative Example D-1

In this comparative example, a liquid composition was prepared by mixing the uncrosslinked addition curable-type liquid silicone rubber and the water-containing gel without the needle-like filler. The uncrosslinked addition curable-type liquid silicone rubber and the water-containing gel were mixed in such a manner that in the resulting pressure member, the porosity as described in Table 1 was obtained. Except for the conditions described here, molding was performed under the same conditions as in Example D-1, thereby providing pressure member No. D-04. The measurement results of the physical properties of pressure member No. D-04 are listed in Table 1.

Experimental Example E

Example E-1

As the needle-like filler, "100-05M" was used. The uncrosslinked addition curable-type liquid silicone rubber, the needle-like filler, and the water-containing gel were mixed as in Example A-1 to prepare a liquid composition in an emulsion state. In this case, the uncrosslinked addition curable-type liquid silicone rubber, the needle-like filler, and the water-containing gel were mixed in such a manner that in the resulting pressure member, the porosity was 60% by volume and the content of the needle-like filler was 4% by volume as described in Table 1.

Molding for the formation of the pressure member was performed as in Example A-1, except for the conditions specified below. A PFA tube (trade name: 451HP-J, manufactured by Du Pont-Mitsui Fluorochemicals Company, Ltd.), serving as a surface layer, having an inner surface that had been subjected to adhesive treatment with a primer and having a thickness of 35 μm and an outside diameter of 19.2 mm was inserted into the cavity of the pipe-shaped mold for cast molding, the mold having an inside diameter of 20 mm, and was fixed on the inner surface of the mold for cast molding in a state of being stretched by 2.0% in the longitudinal direction. Subsequently, an iron mandrel (diameter: 16 mm, length of region for formation of elastic layer: 240 mm), serving as a base that had been subjected to adhesive treatment with a primer, for an A4-size roller was arranged inside the mold for cast molding while supported by the bearings located at both end portions.

Thereafter, pressure member No. E-01 was produced as in Example A-1 with the previously prepared liquid composition. The measurement results of the physical properties of pressure member No. E-01 are listed in Table 1.

Comparative Example E-1

In this comparative example, a liquid composition was prepared by mixing the uncrosslinked addition curable-type liquid silicone rubber and the water-containing gel without the needle-like filler. The uncrosslinked addition curable-type liquid silicone rubber and the water-containing gel were mixed in such a manner that in the resulting pressure member, the porosity as described in Table 1 was obtained. Except for the conditions described here, molding was performed under the same conditions as in Example E-1, thereby providing pressure member No. E-02. The measurement results of the physical properties of pressure member No. E-02 are listed in Table 1.

Experimental Example F

Example F-1

As the needle-like filler, "100-01" was used. The uncrosslinked addition curable-type liquid silicone rubber, the needle-like filler, and the water-containing gel were mixed as in Example A-1 to prepare a liquid composition in an emulsion state. In this case, the uncrosslinked addition curable-type liquid silicone rubber, the needle-like filler, and the water-containing gel were mixed in such a manner that in the resulting pressure member, the porosity was 60% by volume and the content of the needle-like filler was 10% by volume as described in Table 1.

Molding for the formation of the pressure member was performed as in Example A-1, except for the conditions specified below. A PFA tube (trade name: 451HP-J, manufactured by Du Pont-Mitsui Fluorochemicals Company, Ltd.), serving as a surface layer, having an inner surface that had been subjected to adhesive treatment with a primer and having a thickness of 40 μm and an outside diameter of 28.8 mm was inserted into the cavity of the pipe-shaped mold for cast molding, the mold having an inside diameter of 30 mm, and was fixed on the inner surface of the mold for cast molding in a state of being stretched by 1.5% in the longitudinal direction. Subsequently, an iron mandrel (diameter: 23.4 mm, length of region for formation of elastic layer: 360 mm), serving as a base that had been subjected to adhesive treatment with a primer, for an A3-size roller was arranged inside the mold for cast molding while supported by the bearings located at both end portions.

Thereafter, pressure member No. F-01 was produced as in Example A-1 with the previously prepared liquid composition. The measurement results of the physical properties of pressure member No. F-01 are listed in Table 1.

Comparative Example F-1

In this comparative example, a liquid composition was prepared by mixing the uncrosslinked addition curable-type liquid silicone rubber and the water-containing gel without the needle-like filler. The uncrosslinked addition curable-type liquid silicone rubber and the water-containing gel were mixed in such a manner that in the resulting pressure member, the porosity as described in Table 1 was obtained. Except for the conditions described here, molding was performed under the same conditions as in Example F-1, thereby providing pressure member No. F-02. The measurement results of the physical properties of pressure member No. F-02 are listed in Table 1.

Comparative Example F-2

In this comparative example, as with Comparative Example F-1, a liquid composition was prepared by mixing the uncrosslinked addition curable-type liquid silicone rubber and the water-containing gel without the needle-like filler. In this case, the uncrosslinked addition curable-type liquid silicone rubber and the water-containing gel were mixed in such a manner that in the resulting pressure member, the porosity was 80% by volume as described in Table 1.

Except for the conditions described here, molding was performed in the same conditions as in Example F-1. However, the elastic layer was broken at the time of demolding probably because of a reduction in the strength of the elastic layer due to excessively high porosity. That is, it was impossible to produce a pressure member. Thus, the experiment was finished here.

Evaluation of Pressure Member

Each of the produced pressure members was mounted on a corresponding one of the fixing devices listed in Table 2 in such a manner that a pressure load applied to a fixing member and the pressure member was set to a predetermined value. A current started to flow through a ceramic heater of the fixing device at a power listed in Table 2. A warm-up time required to increase the surface temperature of the fixing member to a fixable temperature (preset temperature) of the fixing device was measured.

Subsequently, a sheet feed test was performed by continuously feeding sheets under conditions listed in Table 2. Whether a wrinkle in the circumferential direction was formed or not was checked every 10,000 sheets by observing a portion of the surface layer of the pressure member with which a sheet edge portion was brought into contact. The evaluation results are listed in Table 2.

The present invention is not limited to the foregoing embodiments. Various changes and modifications may be made without departing from the spirit and scope of the invention. Therefore, the following claims are attached in order to make the scope of the present invention public.

TABLE 1

| | | | Elastic layer | | | | | |
|---|---|---|---|---|---|---|---|---|
| | | | | | Needle-like filler | | | |
| | Pressure member No. | Elastic modulus of rubber [MPa] | Thickness [mm] | Porosity [% by volume] | Type | Aspect ratio | Content [% by volume] | Orientation ratio [%] |
| Example A-1 | A-01 | 1.1 | 2.5 | 20 | 100-25M | 28 | 11 | 64 |
| Comparative Example A-1 | A-02 | 1.7 | 2.5 | 20 | — | — | — | — |
| Comparative Example A-2 | A-03 | 1.1 | 2.5 | 10 | 100-25M | 28 | 11 | 65 |
| Example B-1 | B-01 | 1.1 | 3.0 | 40 | 100-15M | 17 | 5 | 60 |
| Comparative Example B-1 | B-02 | 1.5 | 3.0 | 40 | — | — | — | — |
| Example C-1 | C-01 | 1.1 | 2.5 | 40 | 100-01 | 111 | 13 | 67 |
| Comparative Example C-1 | C-02 | 1.5 | 2.5 | 40 | — | — | — | — |
| Example D-1 | D-01 | 0.7 | 2.8 | 50 | 100-25M | 28 | 8 | 63 |

TABLE 1-continued

| | | | | | | | | |
|---|---|---|---|---|---|---|---|---|
| Example D-2 | D-02 | 0.7 | 2.8 | 50 | MLD-300 | 19 | 7 | 62 |
| Example D-3 | D-03 | 0.7 | 2.8 | 50 | 150-01 | 14 | 6 | 61 |
| Comparative Example D-1 | D-04 | 1.5 | 2.8 | 50 | — | — | — | — |
| Example E-1 | E-01 | 1.1 | 2.0 | 60 | 100-05M | 6 | 4 | 64 |
| Comparative Example E-1 | E-02 | 1.1 | 2.0 | 60 | — | — | — | — |
| Example F-1 | F-01 | 0.7 | 3.3 | 60 | 100-01 | 111 | 10 | 63 |
| Comparative Example F-1 | F-02 | 1.1 | 3.3 | 60 | — | — | — | — |
| Comparative Example F-2 | broken at the time of demolding | | | | | | | |

| | Elastic layer | | | Surface layer | | |
|---|---|---|---|---|---|---|
| | E(MD) [MPa] | E(ND) [MPa] | E(MD)/E(ND) | Material | Thickness [μm] | Elongation percentage in longitudinal direction [%] |
| Example A-1 | 13.5 | 1.5 | 9.0 | 451HP-J | 30 | 1.0 |
| Comparative Example A-1 | 1.5 | 1.5 | 1.0 | | | |
| Comparative Example A-2 | 13.4 | 1.7 | 8.0 | | | |
| Example B-1 | 2.3 | 1.1 | 2.0 | P-66P | 30 | 1.5 |
| Comparative Example B-1 | 1.1 | 1.1 | 1.0 | | | |
| Example C-1 | 17.1 | 1.1 | 15.0 | 350-J | 30 | 1.0 |
| Comparative Example C-1 | 1.1 | 1.1 | 1.0 | | | |
| Example D-1 | 9.6 | 1.0 | 10.0 | 451HP-J | 25 | 3.0 |
| Example D-2 | 7.7 | 1.0 | 8.0 | | | |
| Example D-3 | 5.7 | 1.0 | 6.0 | | | |
| Comparative Example D-1 | 1.0 | 1.0 | 1.0 | | | |
| Example E-1 | 1.6 | 0.8 | 2.0 | 451HP-J | 35 | 2.0 |
| Comparative Example E-1 | 0.8 | 0.8 | 1.0 | | | |
| Example F-1 | 11.7 | 0.8 | 15.0 | 451HP-J | 40 | 1.5 |
| Comparative Example F-1 | 0.8 | 0.8 | 1.0 | | | |
| Comparative Example F-2 | broken at the time of demolding | | | | | |

TABLE 2

| | | Heat fixing device | | | | | | Evaluation sheet | | | Whether wrinkle is formed in pressure member near sheet end portion in circumferential direction or not, and number of sheets fed |
|---|---|---|---|---|---|---|---|---|---|---|---|
| | Pressure member No. | Type of device | Pressure load [kgf] | Print direction Print speed [sheets/min] | Power [W] | Preset temperature [° C.] | Warm-up time [sec] | Type | Basis weight [g/m$^2$] | Thickness [μm] | |
| Example A-1 | A-01 | A4-ODF | 20 | longitudinal direction of A4 14 | 700 | 180 | 9.8 | GF-C157 | 157 | 180 | 50,000 sheets, not formed wrinkle formed at 40,000 sheets |
| Comparative Example A-1 | A-02 | | | | | | 9.6 | | | | |
| Comparative Example A-2 | A-03 | | | | | | 10.9 | | | not evaluated | |
| Example B-1 | B-01 | A3-ODF | 30 | transverse direction of A4 31 | 850 | 180 | 18.6 | GF-C209 | 209 | 235 | 150,000 sheets, not formed wrinkle formed at 130,000 sheets |
| Comparative Example B-1 | B-02 | | | | | | 17.8 | | | | |
| Example C-1 | C-01 | A3-ODF | 28 | transverse direction of A4 30 | 900 | 175 | 13.2 | GF-C157 | 157 | 180 | 200,000 sheets, not formed wrinkle formed at 170,000 sheets |
| Comparative Example C-1 | C-02 | | | | | | 12.9 | | | | |
| Example D-1 | D-01 | A3-ODF | 32 | transverse direction of A4 51 | 950 | 180 | 10.9 | GF-C209 | 209 | 235 | 300,000 sheets, not formed |
| Example D-2 | D-02 | | | | | | 10.6 | | | | 300,000 sheets, not formed |
| Example D-3 | D-03 | | | | | | 10.5 | | | | 300,000 sheets, not formed |
| Comparative Example D-1 | D-04 | | | | | | 10.4 | | | | wrinkle formed at 230,000 sheets |

TABLE 2-continued

| | Pressure member No. | Heat fixing device: Type of device | Heat fixing device: Pressure load [kgf] | Heat fixing device: Print direction Print speed [sheets/min] | Heat fixing device: Power [W] | Heat fixing device: Preset temperature [° C.] | Warm-up time [sec] | Evaluation sheet: Type | Evaluation sheet: Basis weight [g/m²] | Evaluation sheet: Thickness [μm] | Whether wrinkle is formed in pressure member near sheet end portion in circumferential direction or not, and number of sheets fed |
|---|---|---|---|---|---|---|---|---|---|---|---|
| Example E-1 | E-01 | A4-ODF | 18 | longitudinal direction of A4 20 | 750 | 185 | 7.1 | GF-C104 | 104 | 124 | 100,000 sheets, not formed wrinkle formed at 60,000 sheets |
| Comparative Example E-1 | E-02 | | | | | | 6.9 | | | | |
| Example F-1 | F-01 | A3-IHF | 34 | transverse direction of A4 60 | 1100 | 190 | 12.8 | GF-C209 | 209 | 235 | 300,000 sheets, not formed wrinkle formed at 180,000 sheets |
| Comparative Example F-1 | F-02 | | | | | | 12.3 | | | | |
| Comparative Example F-2 | F-03 | | | | | | not evaluated | | | | |

* Type of device
A4: A4 type
A3: A3 type
ODF: on-demand fixing device
IHF: IH-type fixing device
* Each of the evaluation sheets is produced by CANON KABUSHIKI KAISHA.

According to still another aspect of the present invention, the pressure member configured to reduce a warm-up time and inhibit the occurrence of a wrinkle extending in the circumferential direction is provided. According to the present invention, the heat fixing device configured to stably form a high-quality electrophotographic image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2014/069052, filed Jul. 17, 2014, which is hereby incorporated by reference herein in its entirety.

The invention claimed is:

1. A pressure member comprising:

a base, an elastic layer on the base, and a surface layer on the elastic layer, the surface layer containing a fluorine-containing resin, wherein the surface layer is fixed on the elastic layer in a state of being stretched in the longitudinal direction of the pressure member, the elastic layer has a porosity of 20% by volume or more and 60% by volume or less, and when the elastic modulus of the elastic layer in the thickness direction is defined as E (ND) and the elastic modulus of the elastic layer in the longitudinal direction of the pressure member is defined as E (MD), E (MD)/E (ND) is larger than 1.0.

2. The pressure member according to claim 1, wherein the elastic layer contains a needle-like filler.

3. The pressure member according to claim 1, wherein the porosity is 40% by volume or more and 60% by volume or less.

4. The pressure member according to claim 1, wherein E (MD)/E (ND) is 2.0 or more and 15.0 or less.

5. The pressure member according to claim 2, wherein the orientation ratio of the needle-like filler in the longitudinal direction of the elastic layer is 50% or more and 70% or less.

6. The pressure member according to claim 2, wherein the needle-like filler has an aspect ratio of 5 or more and 120 or less.

7. The pressure member according to claim 2, wherein the needle-like filler is contained in the elastic layer in an amount of 2% by volume or more and 15% by volume or less.

8. The pressure member according to claim 2, wherein the needle-like filler is a carbon fiber.

9. The pressure member according to claim 1, wherein the elastic modulus E (ND) is 0.2 MPa or more and 2.5 MPa or less.

10. The pressure member according to claim 1, wherein the surface layer is formed of a tube containing a fluorine-containing resin.

11. A heat fixing device comprising a heating member and a pressure member facing the heating member, the pressure member being in pressure contact with the heating member, wherein a material to be heated is introduced into a nip portion between the heating member and the pressure member, held, conveyed, and heated, and wherein the pressure member comprises:

a base, an elastic layer on the base, and a surface layer on the elastic layer, the surface layer containing a fluorine-containing resin, wherein the surface layer is fixed on the elastic layer in a state of being stretched in the longitudinal direction of the pressure member, the elastic layer has a porosity of 20% by volume or more and 60% by volume or less, and when the elastic modulus of the elastic layer in the thickness direction is defined as E (ND) and the elastic modulus of the elastic layer in the longitudinal direction of the pressure member is defined as E (MD), E (MD)/E (ND) is larger than 1.0.

* * * * *